United States Patent [19]

Baum

[11] 4,324,059

[45] Apr. 13, 1982

[54] ATTRACTION AND ENTERTAINMENT DEVICE FOR A VENDING MACHINE

[76] Inventor: Harold D. Baum, 4615 N. Clifton Ave., Chicago, Ill. 60640

[21] Appl. No.: 163,783

[22] Filed: Jun. 27, 1980

[51] Int. Cl.[3] ..... G09F 19/08

[52] U.S. Cl. ..... 40/416; 40/414

[58] Field of Search ..... 40/416, 411, 423

[56] References Cited

U.S. PATENT DOCUMENTS 2,066,310 1/1937 Appel et al. ..... 40/44
2,117,530 5/1938 Willis ..... 40/411
2,604,730 7/1952 Weiss ..... 40/416
2,961,764 11/1960 Sachs et al. ..... 40/411

*Primary Examiner*—Robert Peshock
*Attorney, Agent, or Firm*—Martin Faier

[57] ABSTRACT

In conjunction with a vending machine, a device for attracting attention of the public and entertaining the user of the machine, said device having mechanism for performing eye-catching animated multiple motions for a predetermined period of time upon actuating the selling cycle of the vending machine. The device may also include coupled sound and light generating mechanisms.

12 Claims, 7 Drawing Figures

ATTRACTION AND ENTERTAINMENT DEVICE FOR A VENDING MACHINE

BACKGROUND AND SUMMARY OF THE INVENTION

This invention relates to a device for attracting public attention to and entertaining users of a vending machine, and is more particularly concerned with such a device which has animating mechanism for performing multiple simultaneous eye-catching motions for a predetermined period of time upon actuating the selling cycle of the vending machine.

Conventionally, vending machines have been painted bright, appealing colors and have had light displays incorporated therein for purposes of drawing patrons. Other such machines have used color wheels or other moving mechanism for attracting public attention to their presence. However, as article vending machines have been placed in location where there is greater competition for purchasers, for example in shopping centers, it has been found desirable to provide means for better gaining public attention and to perform an entertainment function for encouraging purchases of commodities from the machine.

In the present invention, the means for attracting public attention and entertaining the vending machine patron is an animated display comprising a series of connected electrically actuated linkages displayed in a novel housing. These linkages are actuated simultaneously upon deposit of a coin in the vending machine, which initiates its selling cycle, when an article of merchandise is selected from the vending machine. The housing for these linkages may simulate a robot or clown head, and the linkages may cause its jaws to open and close, its head to rotate from time to side, its ears to twirl, its eyes to move in and out of their sockets, and its nose and eyes to light. Such dynamic action may be enhanced by a sound track broadcast and additional light displays, also initiated by actuation of the selling cycle of the vending machine.

The device for imparting motion in the present invention may be secured to the top of a conventional vending machine cabinet, the power supply therefor being actuated upon deposit of a coin into the vending machine and selection of merchandise therein. Except for the electrical take-off and starting switch assembly, the device embodying the present invention may be independent of and merely mounted on the vending machine; and the device contains its own means for driving the linked motion performing mechanisms, so that it may be almost univerally used on all different makes and models of commodity vending machines. Preferably, the outer shell for the device is fabricated from transparent material, such as blow molded plastic, and mounted on the vending machine cabinet top over the drive and linkage housing to protect the mechanism from tampering.

OBJECTS OF THE INVENTION

It is therefore an object of the invention to provide an attraction and entertainment device for a vending machine of the character recited.

Another object is to provide novel connected linkage and drive means therefor which performs multiple motions simultaneously, visible through a transparent shell from the exterior of the vending machine.

Another object is to provide novel linkages connected to drive means for performing rotating, revolving, reciprocating, pivoting and twirling movements simultaneously.

Another object is to provide a novel switching means for actuating an attracting and entertainment device upon initiating the selling cycle of a vending machine.

Another object is to provide a sound broadcast and light display system for an attracting and entertainment device which is actuated simultaneously with mechanism for performing multiple motions.

Another object is to provide a novel transparent cover for securing an attracting and entertainment device on a vending machine cabinet.

Another object is to provide a device of the character recited which is not difficult or expensive to manufacture or service and which is adequately versatile for use on many makes and models of vending machines.

Another object is to provide a device of the character recited which is efficient in operation and effective for inducing patrons to use a vending machine with which such a device is associated.

The structure by means of which the above noted and other objects and advantages of the intention are attained will be described in the following specification, taken in conjunction with the accompanying drawing, showing a preferred illustrative embodiment of the invention.

DESCRIPTION OF AN ILLUSTRATIVE EMBODIMENT

Figure 1:
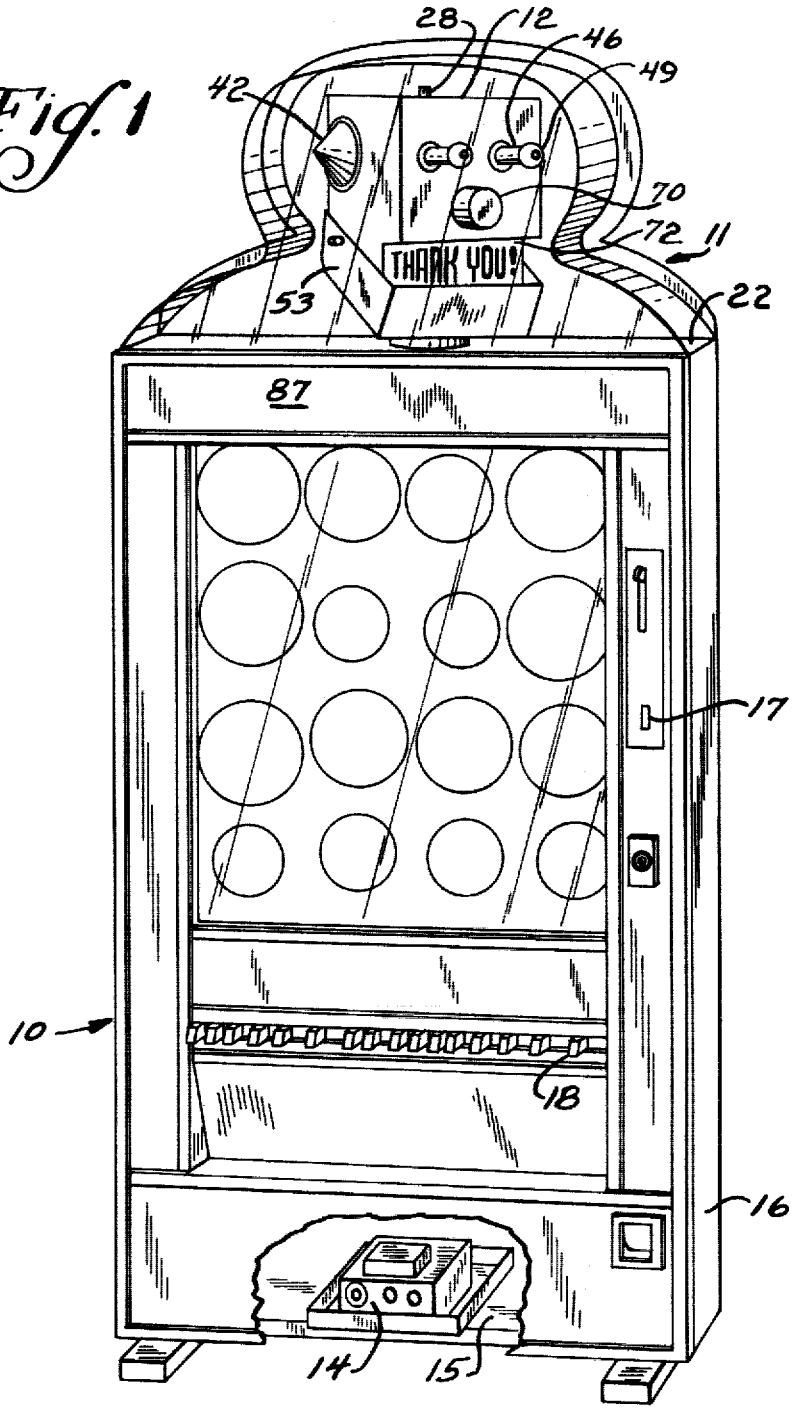
FIG. 1 is a perspective view of a vending machine, with part broken away to reveal the location of the sound generating mechanism, showing a device embodying the present invention mounted thereto.
Figure 2:
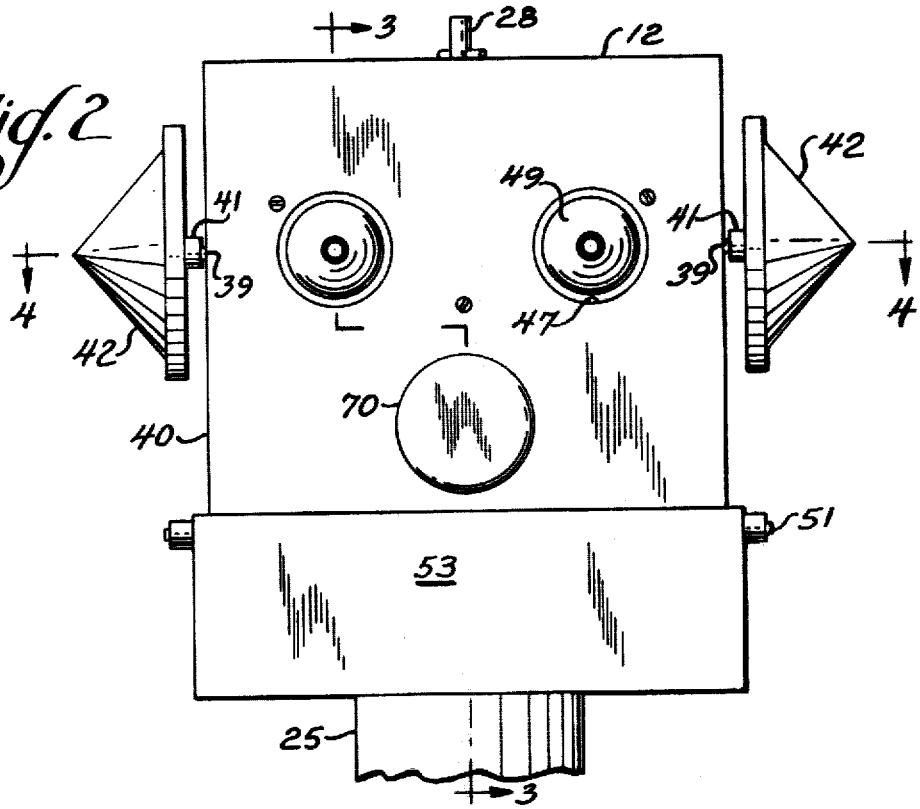
FIG. 2 is a front elevational view of housing for the linkages and associated structure.
Figure 3A:
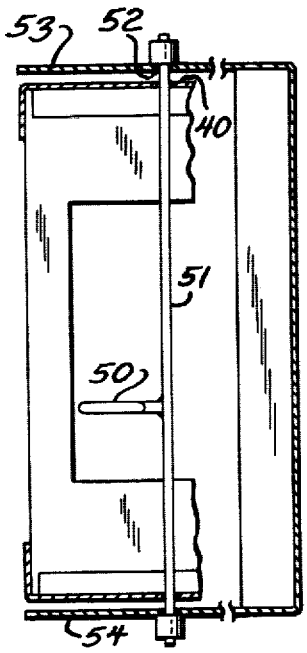
FIG. 3*a* is a detailed sectional view of part of the housing and linkages taken on line 3*a*—3*a* of FIG. 3.
Figure 3:
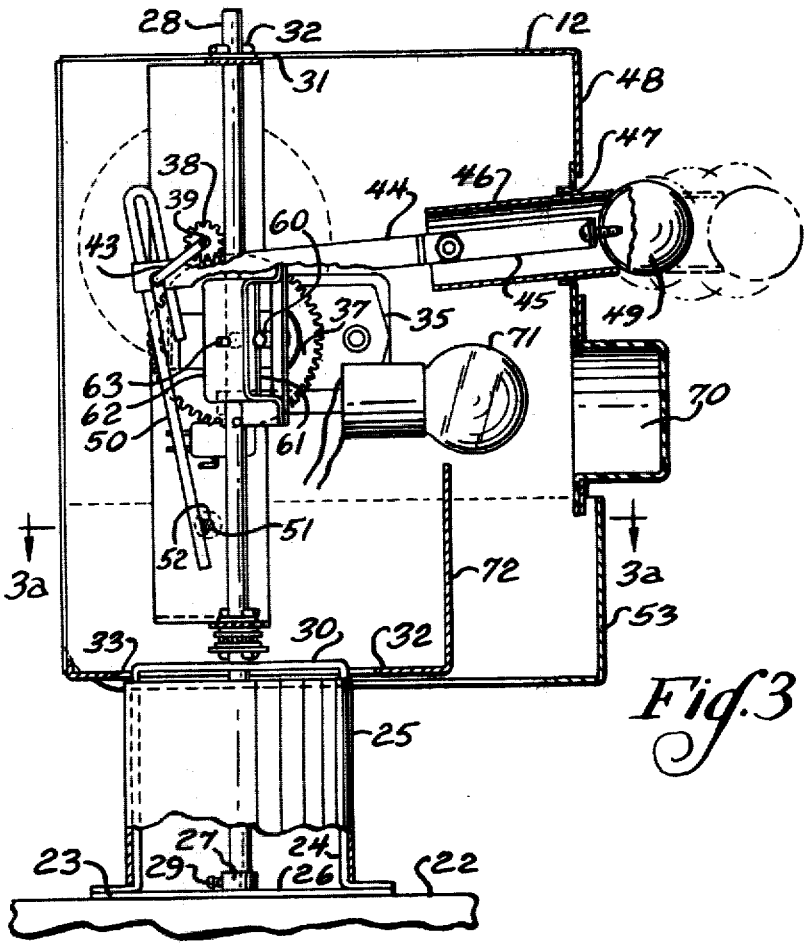
FIG. 3 is a sectional view of the housing and linkages taken on line 3—3 of FIG. 2.
Figure 4:
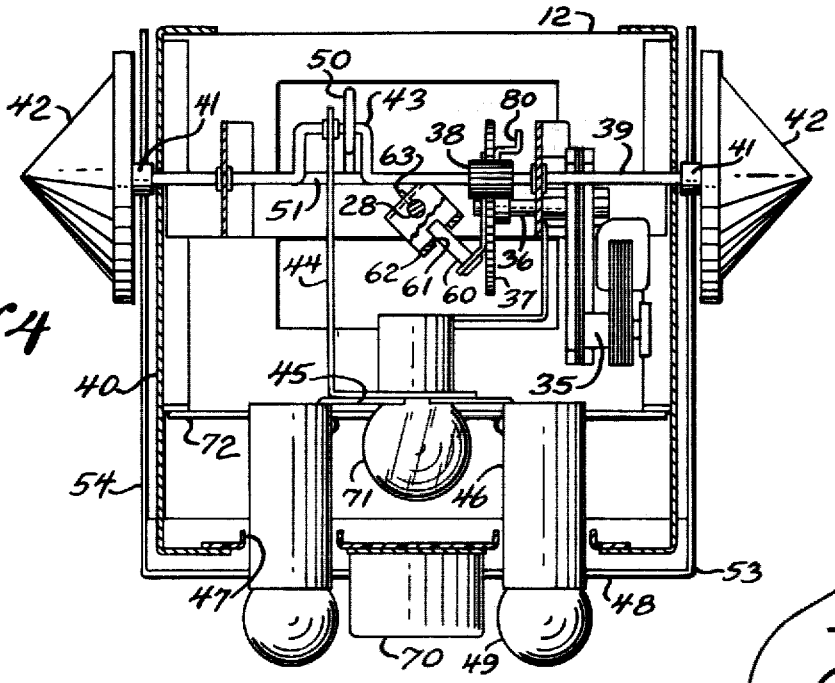
FIG. 4 is a sectional view of the housing and linkages taken on line 4—4 of FIG. 2.

With reference to the accompanying drawings and particularly to FIGS. 1–5, secured on a vending machine 10 is a transparent cover 11 housing a robot or clown head 12 which contains the linkages embodying the present invention. The illustrative device may also include sound generating mechanism 14 secured on the base 15 of the vending machine cabinet 16. The vending cycle of the machine may be activated by deposit of a coin in a coin chute 17 and then actuating a selector button 18 on the face of the vending machine 10. Actuation of the selector button 18 will cause an arm 19 to rock on its pivot 20, thus contacting a switching member 21 which energizes the circuit of the device embodying the invention in a manner to be described.

The head 12 is secured to the top 22 of the vending machine 10 by means of flanges 23 on an upstanding frame 24 which carries a collar 25. Secured at the base 26 of the collar 25 is a bearing 27 into which is secured an upstanding shaft 28, as by means of a set screw 29. This shaft 28 extends upwardly through a centering bracket 30 and the top wall 31 of the head 12, where the head 12 is secured onto the shaft 28 by means of fasteners 32. The bottom wall 32 of the head 12 has an aperture 33, and the head is free to rotate from side to side on the shaft 28.

Within the head 12 is an electrical motor 35 whose drive shaft 36 drives a gear 37 which meshes with another gear 38 causing a second shaft 39 to rotate. The ends of the second drive shaft 39 extend through side walls 40 of the head 12 and are connected by axles 41 into oppositely disposed ears 42, one on each side of the head, causing the ears to spin when the shaft 39 is turned. This second drive shaft 39 also has intermediate its ends a bell crank 43, connected to an arm 44, which is joined to a pair of plunger brackets 45, each of which has a tubular leg 46 extending through apertures 47 in the face wall 48 of the head 12. A spherical body 49, such as a translucent ping pong ball, is secured on the free end of each leg 46, and the ends of the legs and the spherical bodies move in a direction toward and away from the head as the second drive shaft 39 rotates (as shown in dotted lines in FIG. 3).

Also secured on the bell crank 43 is a rod 50 which moves therewith and is connected to a horizontal shaft 51 rockable on pivots 52 joining the jaw member 53 to the head 12. The jaw member 53 is U-shaped and its side walls 54 extend parallel to side walls 40 of the head 12, and the jaw member opens and closes relative to the head as the rod 50 moves shaft 51 on pivots 52 when the bell crank 43 is turned by the second drive shaft 39.

The head 12 is rotated from side to side by means of an angularly disposed pin 60 mounted off-center on gear 37 slidable in vertically disposed slot 61 formed in a bracket 62 which is fixed on shaft 28 by pin 63, so that the head is driven from side to side as pin 60 is tracked in slot 61.

Preferably, the nose 70 and the spherical bodies 49 simulating eyes are translucent and a lamp 71 is mounted within the head 12, which causes the nose and eyes to be illuminated. A plate 72 carrying indicia is disposed upstanding on the bottom wall 32 of the head 12 in line to be illuminated by light from lamp 71 so that when the jaw member 53 is opened the indicia is readable from the exterior of the head 12.

Figure 5:
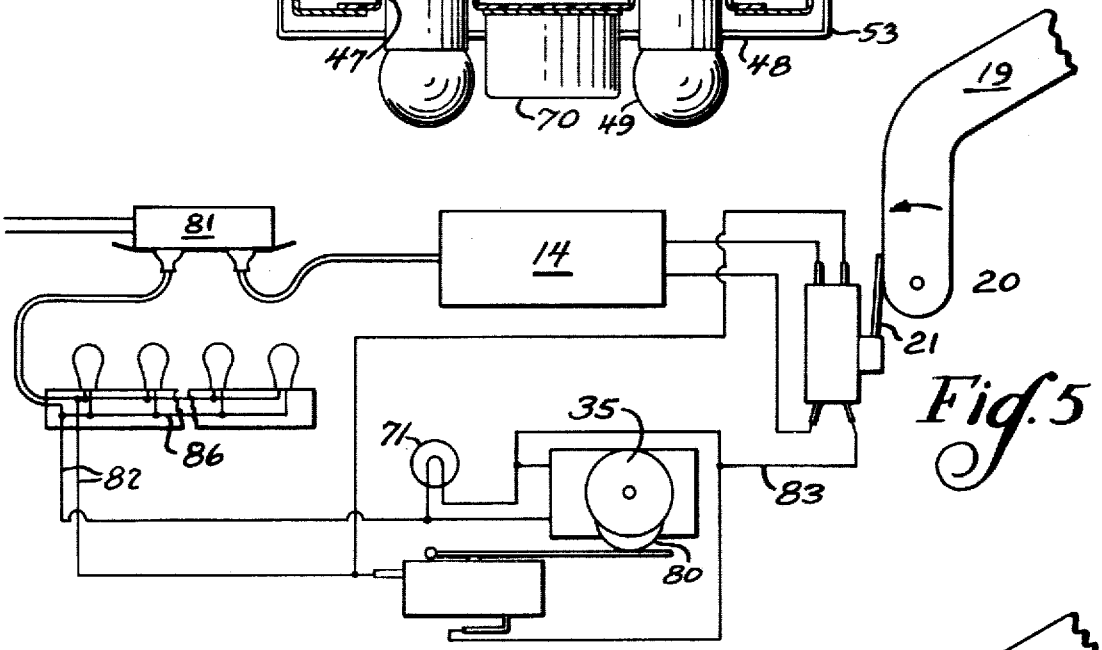
FIG. 5 is a schematic view of the electrical circuit and mechanism embodying the invention shown in FIGS. 1–4.

As shown in FIG. 5, when the damper arm 19 is rocked on pivot 21 at the beginning of the vending cycle, the arm contacts the switch 21, which is a normally open double pole switch. Current flows from the power source 81 to a tape player—speaker sound generating mechanism 14 and to the motor 35 and lamp 71 to complete a circuit from the power source 81 through power supply lines 82 and line 83, thus causing the device to operate. Upon completion of a full revolution of the gear 37, a cam 80 contacts another switch 83 to interrupt the circuit, thus cutting off power to motor 35 which turned the head 12 to its initial position ready for the next actuation of the device.

Figure 6:
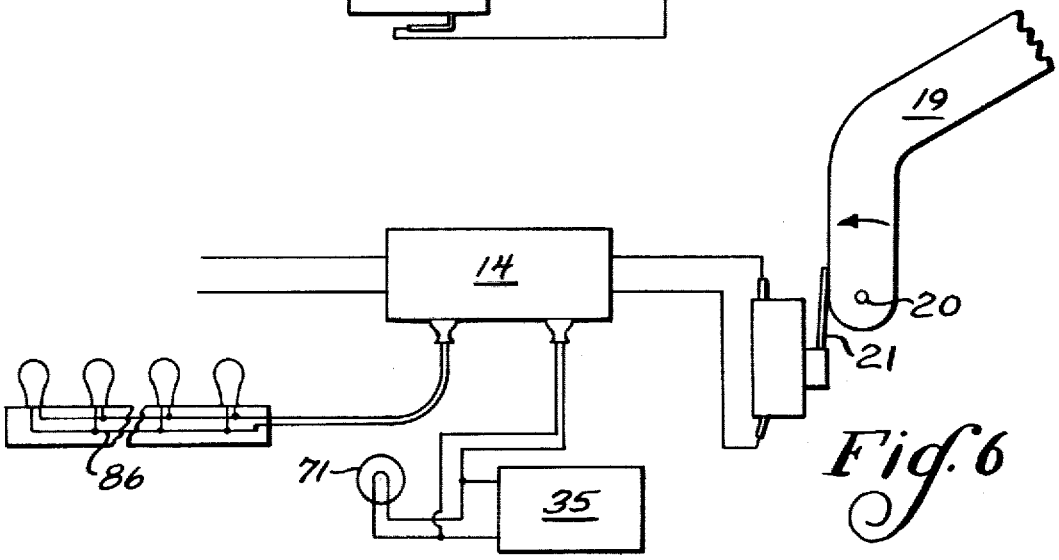
FIG. 6 is a schematic view of a modified embodiment of the electric circuit and mechanism for part of the device showing alternative means for delivering current to the elements of the combination.

In the FIG. 6 modification, power is delivered directly to the tape player—speaker sound generating mechanism 14, which is remotely started by actuation of the switch 21 in the manner previously described. In this modified embodiment, power is delivered to the motor 35 and lamp 71 through the sound generating mechanism 14.

An auxiliary lamp display 86 may be incorporated into either of the circuits shown and connected to power through the motor 35 and light 71 line 83 to the power source 81, as shown in FIG. 5, or to the sound generating mechanism 14, as shown in FIG. 6. In either event, these lights of the lamp display will be illuminated only when the device is actuated. The auxiliary lamp display 86 may include conventional flashers or electronic components, and these lamps may be arranged behind a transparent panel 87 on the face of the vending machine 10.

While illustrative embodiments of the invention have been shown and described, it is not intended that the invention be limited to the exact structure disclosed, as many changes and modifications may be made in the construction without departing from the spirit or scope of the invention.

I claim:

1. An animated device simulating the head of a figure having movable eye, ear and jaw elements operable upon actuation of a vending machine, said device comprising, in combination: an upright support secured on said vending machine; a housing in the shape of a head secured for pivotal movement in a horizontal plane on said support; a motor having a rotatable drive shaft secured in and to said housing; drive means mounted in said housing operably connecting said eye, ear and jaw elements to said motor drive shaft for movement therewith, said drive means consisting of a gear secured to said motor drive shaft, a second gear intermeshed therewith, a second drive shaft axially aligned and connected for rotation with said second gear, a bell crank on said second drive shaft, and connections from said second drive shaft and bell crank for moving said eye, ear and jaw elements; linkage mechanism on said support and said motor drive shaft gear cooperating for reciprocally pivoting said housing on said support in a horizontal plane responsive to rotation of said motor drive shaft; and electric means for delivering current to said motor.

2. The animated device recited in claim 1, wherein said housing has an upstanding wall which carries a translucent member simulating a nose, and illuminating means for said translucent member is secured in said housing.

3. The animated device recited in claim 1, wherein a transparent shell covers said support and housing.

4. The animated device recited in claim 1, wherein said linkage mechanism comprises cooperating pin and slot connections on said support and motor drive shaft gear.

5. The animated device recited in claim 1, wherein one of said movable ear element comprises revolvable members connected to said second drive shaft on opposed sides of said housing.

6. The animated device recited in claim 1, wherein one of said movable eye element comprises arm means movable with said bell crank and having a free end extending through said housing.

7. The animated device recited in claim 6, wherein a translucent sphere-like member is connected to the free end of said arm means.

8. The animated device recited in claim 1, wherein one said jaw element is pivotally connected to said housing and secured to said bell crank.

9. The animated device recited in claim 2, wherein said housing has a panel below said illuminating means which is exposed upon pivotal movement of said jaw element.

10. The animated device recited in claim 1, wherein said electric means has a normally open switch in said vending machine closed upon actuation of said vending machine to operate said motor, and an electrical circuit connecting said switch and motor.

11. The animated device recited in claim 10, wherein a sound generating system is electrically connected in said circuit and operable upon closing said switch.

12. The animated device recited in claim 10, wherein said electric means has an element for opening said switch after said mechanism has operated for a predetermined period of time.

* * * * *